US009644878B2

(12) United States Patent
Mitchell et al.

(10) Patent No.: US 9,644,878 B2
(45) Date of Patent: May 9, 2017

(54) ICE MAKING ASSEMBLY AND AN ICE BUCKET

(71) Applicant: General Electric Company, Schenectady, NY (US)

(72) Inventors: Alan Joseph Mitchell, Louisville, KY (US); Charles Benjamin Miller, Louisville, KY (US); Bart Andrew Nuss, Fisherville, KY (US); Ansuraj Seenivasan, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 697 days.

(21) Appl. No.: 14/075,330

(22) Filed: Nov. 8, 2013

(65) Prior Publication Data

US 2015/0128633 A1 May 14, 2015

(51) Int. Cl.
*F25C 1/14* (2006.01)
*F25C 5/00* (2006.01)
*F25C 5/18* (2006.01)

(52) U.S. Cl.
CPC ..... *F25C 1/147* (2013.01); *F25C 5/005* (2013.01); *F25C 5/18* (2013.01)

(58) Field of Classification Search
CPC .. F25C 5/182; F25C 5/18; F25C 5/007; F25C 5/005; F25C 1/147
See application file for complete search history.

(56) References Cited

U.S. PATENT DOCUMENTS

| | | | | |
|---|---|---|---|---|
| 2,410,672 | A | 10/1941 | Muffly | |
| 2,672,016 | A | 9/1948 | Muffly | |
| 2,695,502 | A | 11/1950 | Muffly | |
| 3,406,871 | A * | 10/1968 | Hoenisch | A23G 9/045 222/129.3 |
| 4,276,750 | A * | 7/1981 | Kawasumi | B67D 1/00 221/96 |
| 5,165,255 | A * | 11/1992 | Alvarez | F25C 5/182 222/129.1 |
| 7,216,499 | B2 | 5/2007 | Flinner et al. | |
| 2007/0186570 | A1 | 8/2007 | Kopf | |
| 2009/0293501 | A1 | 12/2009 | Kulkarni et al. | |
| 2012/0118001 | A1 | 5/2012 | Mitchell et al. | |
| 2013/0087582 | A1 * | 4/2013 | Wing | G01F 11/24 222/240 |
| 2013/0104591 | A1 | 5/2013 | Mitchell | |

* cited by examiner

*Primary Examiner* — Cassey D Bauer
(74) *Attorney, Agent, or Firm* — Dority & Manning, P.A.

(57) ABSTRACT

An ice making assembly and an ice bucket are provided. The ice bucket includes a sidewall that defines a storage volume and an auger disposed within the storage volume. A motor is configured for rotating the auger within the storage volume. The motor is positioned above the storage volume along a vertical direction. The position of the motor relative to the storage volume can assist with limiting or preventing damage to the motor.

19 Claims, 11 Drawing Sheets

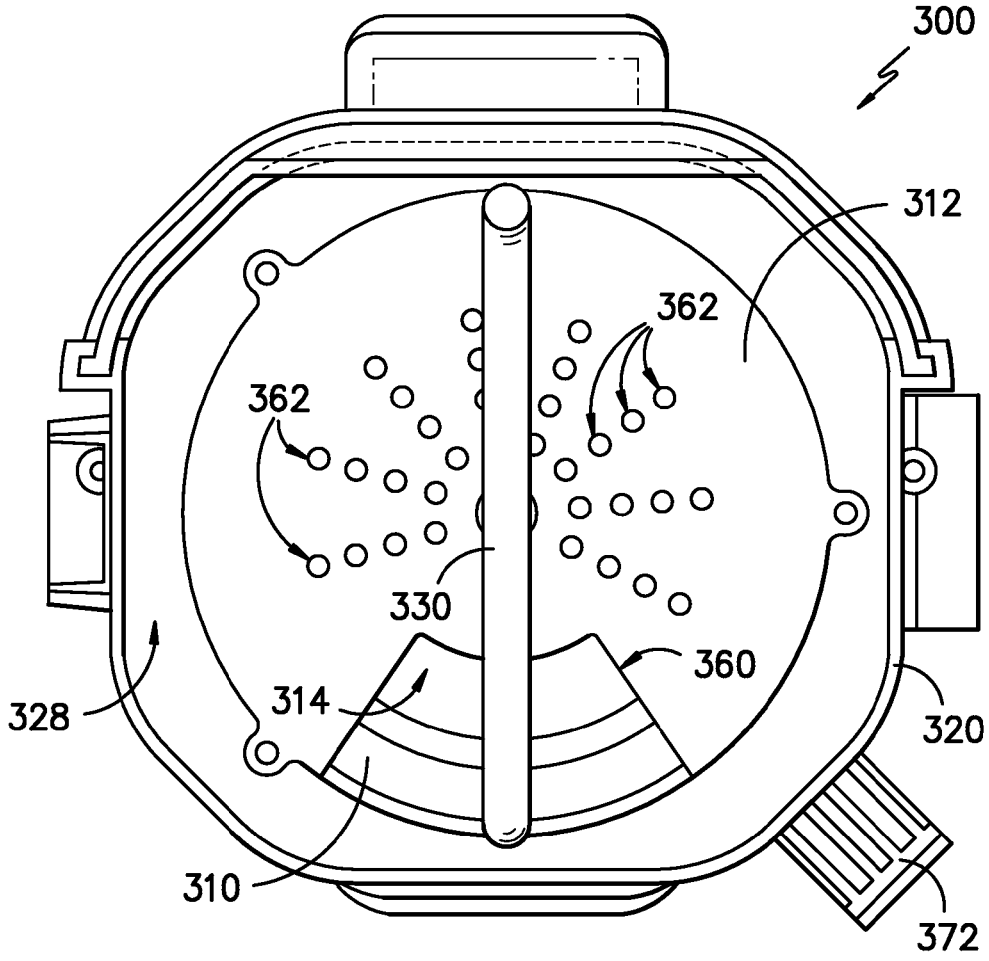
FIG. –10–

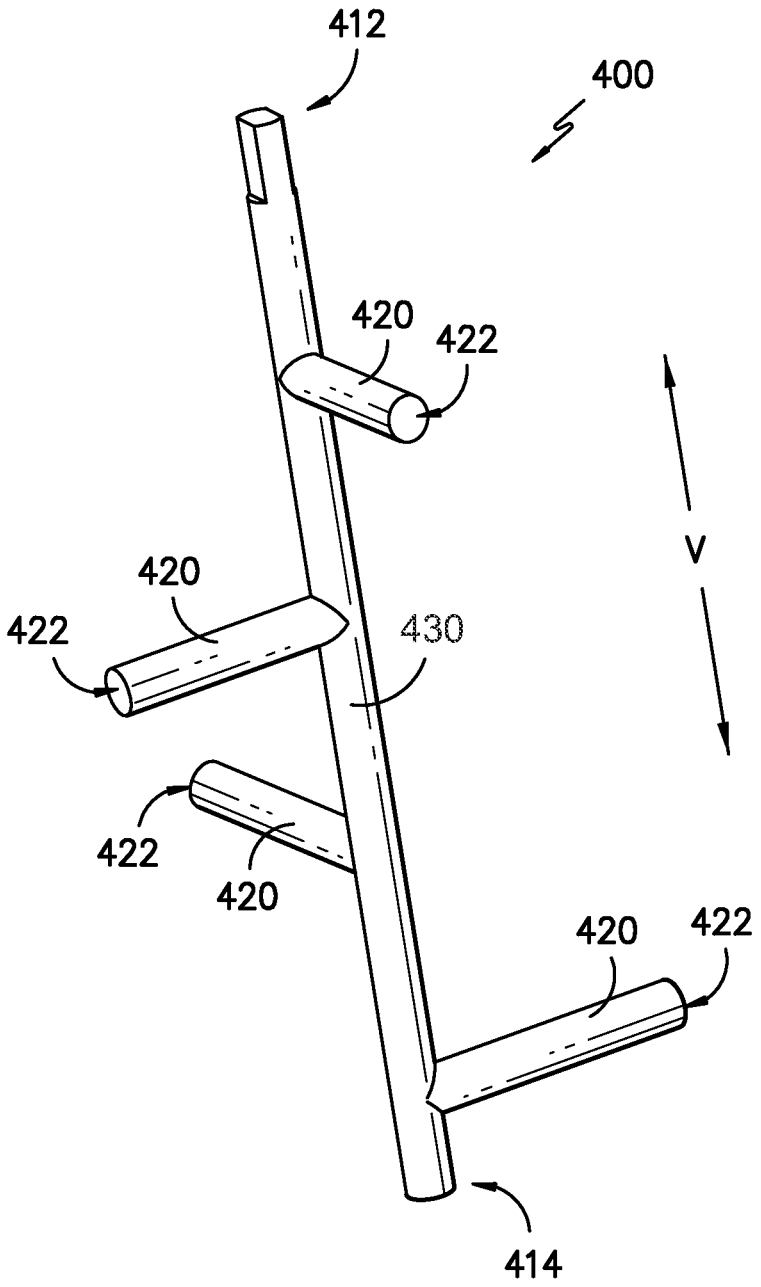
FIG. –11–

ICE MAKING ASSEMBLY AND AN ICE BUCKET

FIELD OF THE INVENTION

The present subject matter relates generally to ice makers, such as nugget style ice makers, and ice buckets.

BACKGROUND OF THE INVENTION

Certain refrigerator appliances include an ice maker. To produce ice, liquid water is directed to the ice maker and frozen. A variety of ice types can be produced depending upon the particular ice maker used. For example, certain ice makers include a mold body for receiving liquid water. An auger within the mold body can rotate and scrape ice off an inner surface of the mold body to form ice nuggets. Such ice makers are generally referred to as nugget style ice makers. Certain consumers prefer nugget style ice makers and their associated ice nuggets.

Ice nuggets are generally stored at temperatures above the freezing temperature of liquid water to maintain a texture of the ice nuggets. When stored at such temperatures, ice nuggets can clump such that dispensing the ice nuggets is difficult. In particular, the ice nuggets can collect in corners of the refrigerator appliance's ice bucket.

In addition, ice nuggets can melt when stored at temperatures above freezing, and liquid water from melted ice nuggets can collect within the ice bucket. The liquid water can negatively affect performance of the refrigerator appliance and can be difficult to remove. In particular, liquid water can damage or negatively affect performance of electrical components, such as motors.

Accordingly, an ice bucket for storing ice nuggets with features for assisting with dispensing ice nuggets from the ice bucket would be useful. In addition, an ice bucket for storing ice nuggets with features for limiting or preventing damage to electrical components would be useful.

BRIEF DESCRIPTION OF THE INVENTION

The present subject matter provides an ice making assembly for a refrigerator appliance and an ice bucket. The ice bucket includes a sidewall that defines a storage volume and an auger disposed within the storage volume. A motor is configured for rotating the auger within the storage volume. The motor is positioned above the storage volume along a vertical direction. The position of the motor relative to the storage volume can assist with limiting or preventing damage to the motor. Additional aspects and advantages of the invention will be set forth in part in the following description, or may be apparent from the description, or may be learned through practice of the invention.

In a first exemplary embodiment, an ice making assembly is provided. The ice making assembly defines a vertical direction and includes a casing and an ice making auger rotatably mounted within the casing. An ice making motor is configured for selectively rotating the ice making auger within the casing. An ice bucket includes a bottom wall and a sidewall. The sidewall extends between a top portion and a bottom portion along the vertical direction. The sidewall defines an opening at the top portion of the sidewall. The sidewall is mounted to the bottom wall at the bottom portion of the sidewall. The sidewall defines a storage volume. The opening is positioned for receiving ice nuggets from the casing such that ice nuggets from the casing enter the storage volume at the opening. An ice bucket auger is disposed within the storage volume. An ice bucket motor is configured for selectively rotating the ice bucket auger within the storage volume. The ice bucket motor is positioned above the storage volume along the vertical direction.

In a second exemplary embodiment, an ice bucket for storing ice nuggets is provided. The ice bucket defines a vertical direction. The ice bucket includes a bottom wall and a sidewall. The sidewall extends between a top portion and a bottom portion along the vertical direction. The sidewall defines an opening at the top portion of the sidewall. The sidewall is mounted to the bottom wall at the bottom portion of the sidewall. The sidewall defines a storage volume. The opening is sized for receiving the ice nuggets such that the ice nuggets enter the storage volume at the opening. An auger is disposed within the storage volume. A motor is configured for selectively rotating the auger within the storage volume. The motor is positioned above the storage volume along the vertical direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 10 provides a top, section view of the exemplary ice bucket of FIG. 6.

FIG. 11 provides a perspective view of an auger according to an exemplary embodiment of the present subject matter.

DETAILED DESCRIPTION

Figure 1:
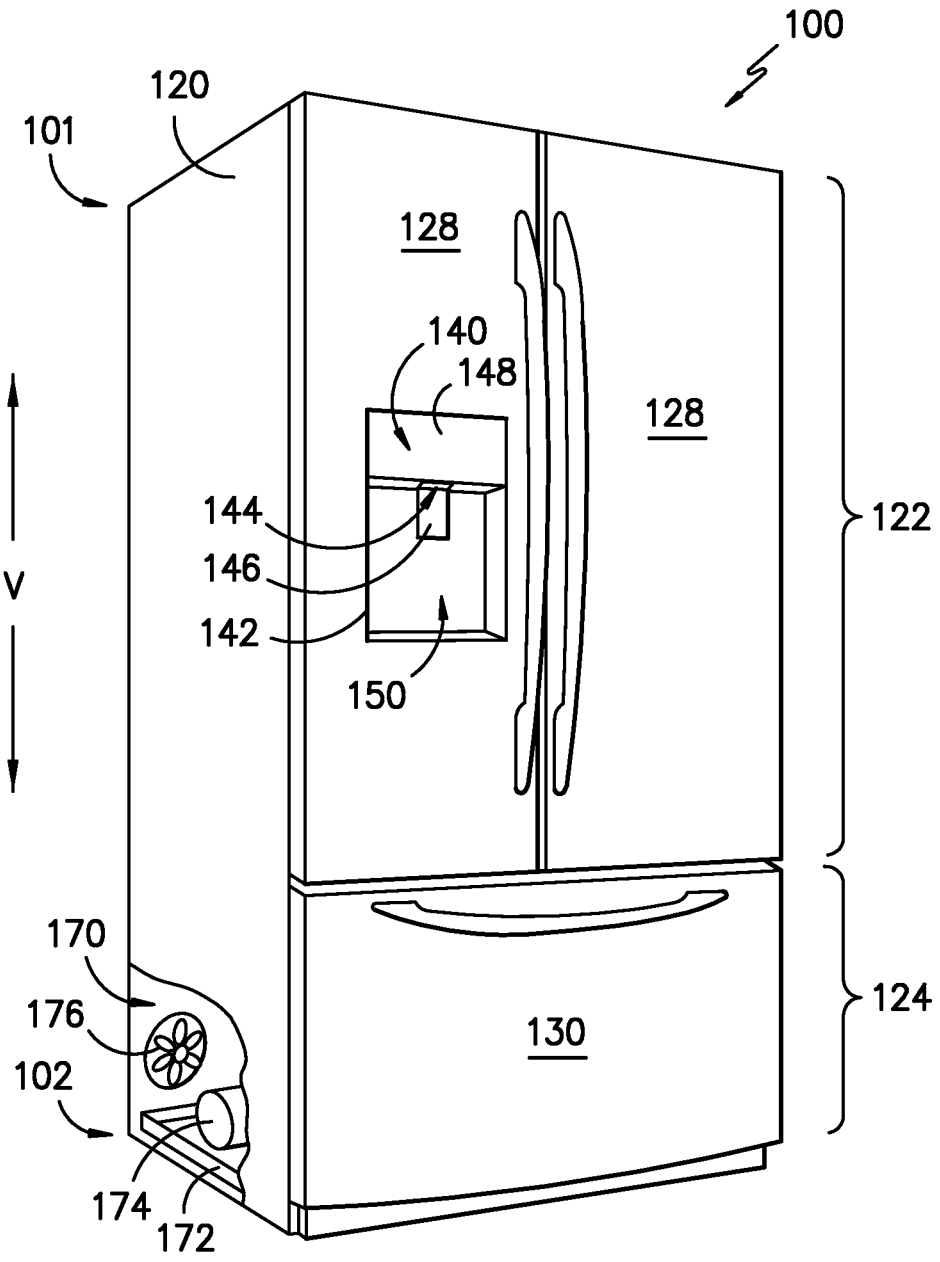
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 120 that extends between a top portion 101 and a bottom portion 102 along a vertical direction V. Housing 120 defines chilled chambers for receipt of food items for storage. In particular, housing 120 defines fresh food chamber 122 positioned at or adjacent top portion 101 of housing 120 and a freezer chamber 124 arranged at or adjacent bottom portion 102 of housing 120. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 120. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 120. In the exemplary embodiment, dispenser recess 150 is positioned at a level that approximates the chest level of a user.

Figure 2:
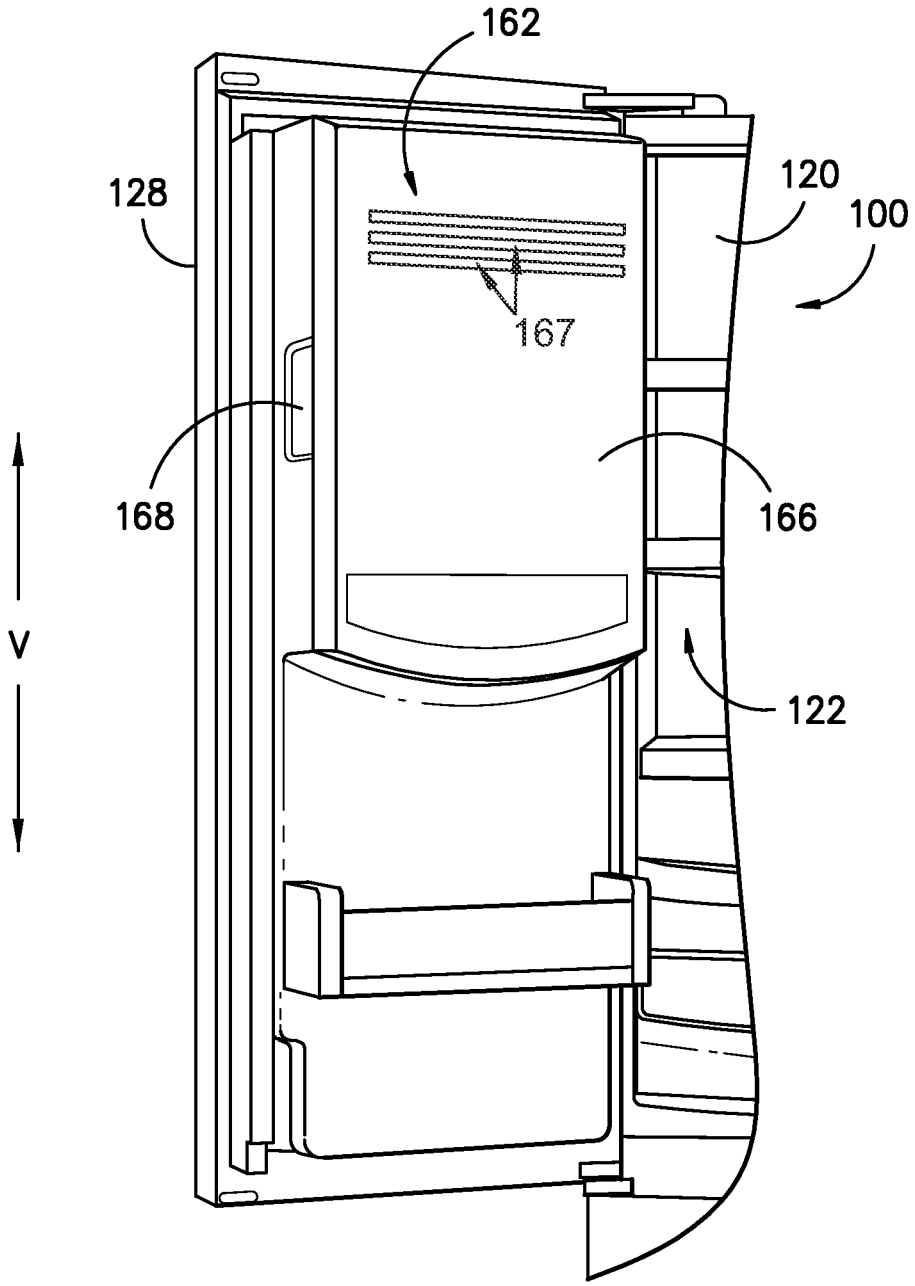
FIG. 2 provides a perspective view of a door of the exemplary refrigerator appliance of FIG. 1.
Figure 3:
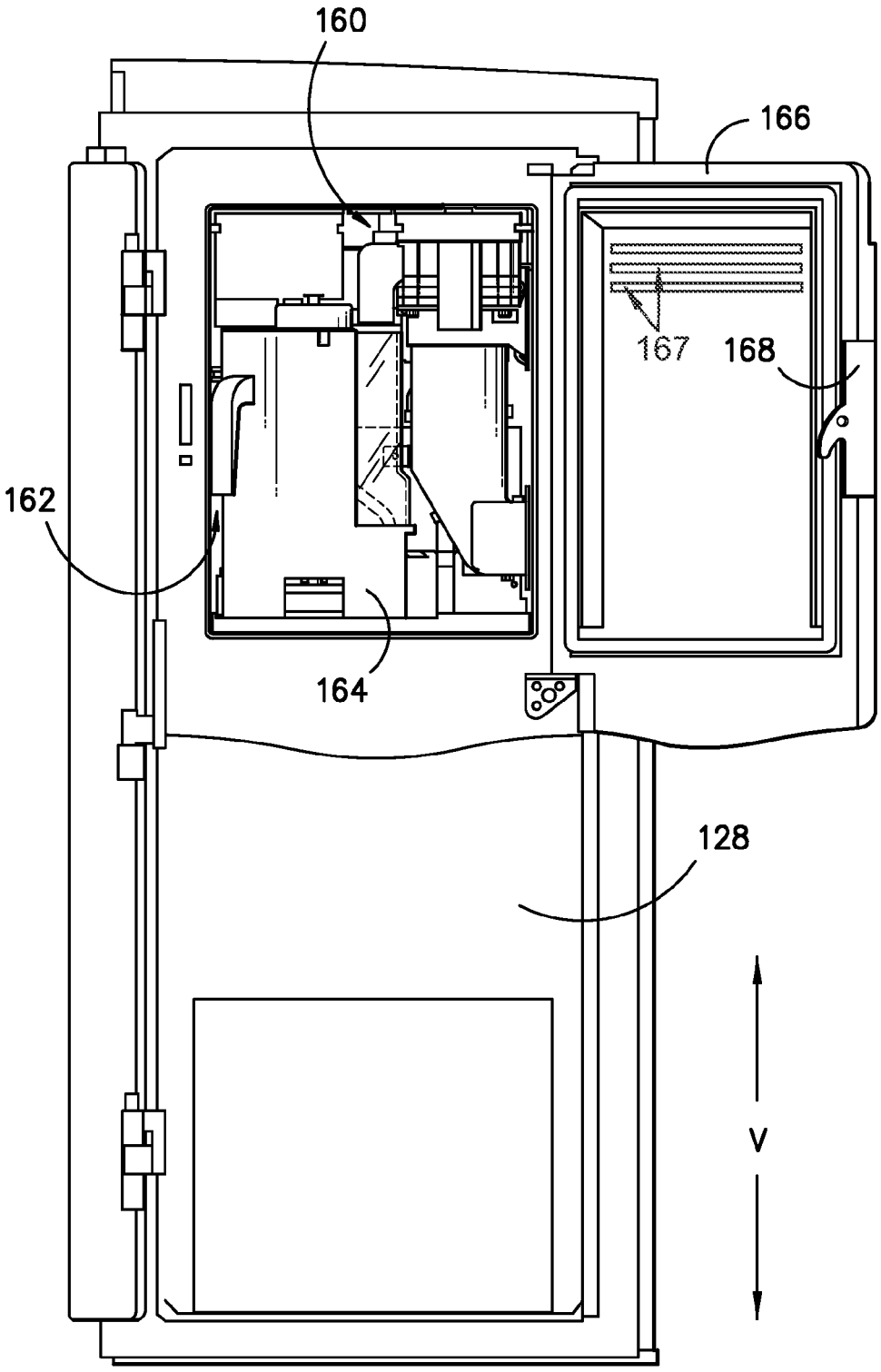
FIG. 3 provides an elevation view of the door of the exemplary refrigerator appliance of FIG. 2 with an access door of the door shown in an open position.

FIG. 2 provides a perspective view of a door of refrigerator doors 128. FIG. 3 provides an elevation view of refrigerator door 128 with an access door 166 shown in an open position. Refrigerator appliance 100 includes a freezer sub-compartment 162 defined on refrigerator door 128. Freezer sub-compartment 162 is often referred to as an "icebox." Freezer sub-compartment 162 extends into fresh food chamber 122 when refrigerator door 128 is in the closed position.

As may be seen in FIG. 3, an ice maker or ice making assembly 160 and an ice storage bin 164 are positioned or disposed within freezer sub-compartment 162. Thus, ice is supplied to dispenser recess 150 (FIG. 1) from the ice making assembly 160 and/or ice storage bin 164 in freezer sub-compartment 162 on a back side of refrigerator door 128. Chilled air from a sealed system (not shown) of refrigerator appliance 100 may be directing into ice making assembly 160 in order to cool ice making assembly 160. During operation of ice making assembly 160, chilled air from the sealed system cools components of ice making assembly 160, such as a casing or mold body of ice making assembly 160, to or below a freezing temperature of liquid water. Thus, ice making assembly 160 is an air cooled ice making assembly. Chilled air from the sealed system also cools ice storage bin 164. In particular, air around ice storage bin 164 can be chilled to a temperature above the freezing temperature of liquid water, e.g., to about the temperature of fresh food chamber 122, such that ice nuggets in ice storage bin 164 melt over time due to being exposed to air having a temperature above the freezing temperature of liquid water. In particular, slots 167 in access door 166 can permit air from fresh food chamber 122 into freezer sub-compartment 162 such that ice storage bin 164 is exposed to air from fresh food chamber 122.

Liquid water generated during melting of ice nuggets in ice storage bin 164, is directed out of ice storage bin 164. In particular, turning back to FIG. 1, liquid water from melted ice nuggets is directed to an evaporation pan 172. Evaporation pan 172 is positioned within a mechanical compartment 170 defined by housing 120, e.g., at bottom portion 102 of housing 120. A condenser 174 of the sealed system can be positioned, e.g., directly, above and adjacent evaporation pan 172. Heat from condenser 174 can assist with evaporation of liquid water in evaporation pan 172. A fan 176 configured for cooling condenser 174 can also direct a flow air across or into evaporation pan 172. Thus, fan 176 can be positioned above and adjacent evaporation pan 172. Evaporation pan 172 is sized and shaped for facilitating evaporation of liquid water therein. For example, evaporation pan 172 may be open topped and extend across about a width and/or a depth of housing 120.

Access door 166 is hinged to refrigerator door 128. Access door 166 permits selective access to freezer sub-compartment 162. Any manner of suitable latch 168 is configured with freezer sub-compartment 162 to maintain access door 166 in a closed position. As an example, latch 168 may be actuated by a consumer in order to open access door 166 for providing access into freezer sub-compartment 162. Access door 166 can also assist with insulating freezer sub-compartment 162.

Figure 4:
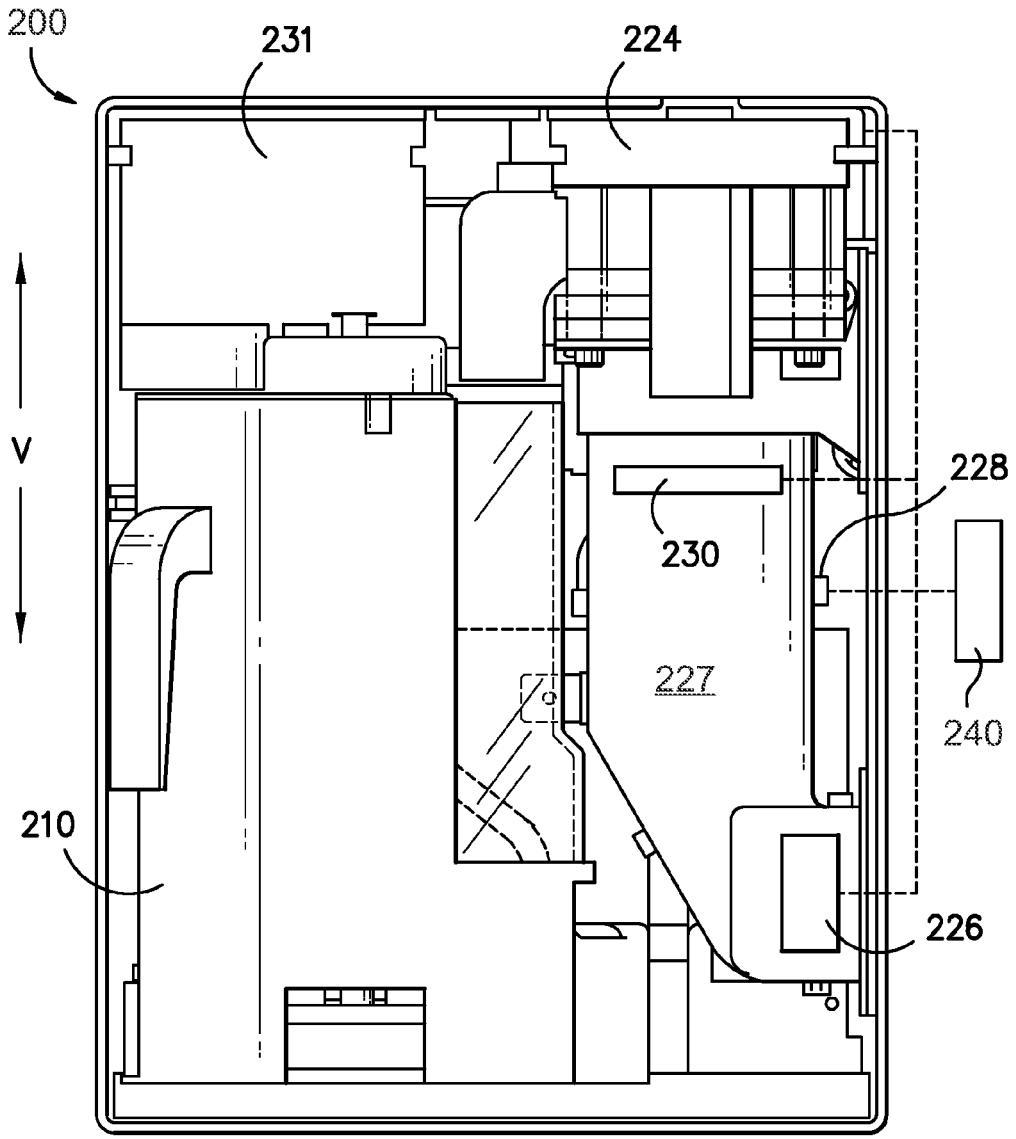
FIG. 4 provides an elevation view of an ice making assembly according to an exemplary embodiment of the present subject matter.
Figure 5:
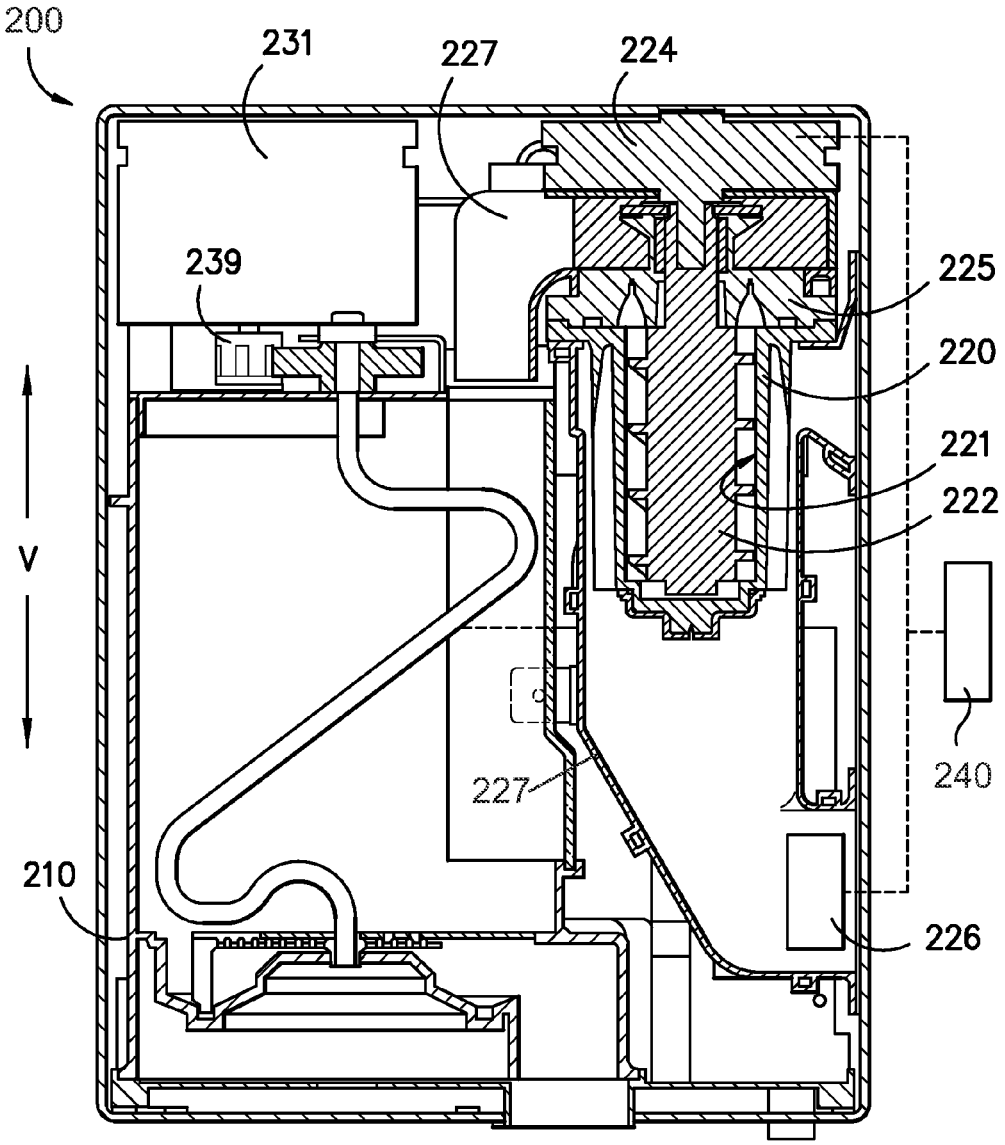
FIG. 5 provides a section view of the exemplary ice making assembly of FIG. 3.

FIG. 4 provides an elevation view of an ice making assembly 200 according to an exemplary embodiment of the present subject matter. FIG. 5 provides a section view of ice making assembly 200. Ice making assembly 200 can be used in any suitable refrigerator appliance. For example, ice making assembly 200 may be used in refrigerator appliance 100 as ice making assembly 160 (FIG. 3).

Ice making assembly 200 includes a mold body or casing 220. An ice making auger 222 (FIG. 3) is rotatably mounted within casing 220. In particular, an ice making motor 224 is mounted to casing 220 and is in mechanical communication with (e.g., coupled to) ice making auger 222. Ice making motor 224 is configured for selectively rotating ice making auger 222 within casing 220. During rotation of ice making auger 222 within casing 220, ice making auger 222 scrapes or removes ice off an inner surface 221 of casing 220 and directs such ice to an extruder 225. At extruder 225, ice nuggets are formed from ice within casing 220. An ice storage bin or ice bucket 210 is positioned below extruder 225 and receives the ice nuggets from extruder 225 via an ice nugget conduit 227. From ice bucket 210, the ice nuggets can enter dispensing assembly 140 (FIG. 1) and be accessed by a user as discussed above. In such a manner, ice making assembly 200 can produce or generate ice nuggets.

Ice making assembly 200 also includes a fan 226. Fan 226 is configured for directing a flow of chilled air through a housing or duct 227 towards casing 220. As an example, fan 226 can direct chilled air from an evaporator of a sealed system through duct 227 to casing 220. Thus, casing 220 can be cooled with chilled air from fan 226 such that ice making assembly 200 is air cooled in order to form ice therein. Ice making assembly 200 also includes a heater 230 (FIG. 4), such as an electric resistance heating element, mounted to casing 220. Heater 230 is configured for selectively heating casing 220, e.g., when ice prevents or hinders rotation of ice making auger 222 within casing 220.

Operation of ice making assembly 200 is controlled by a processing device or controller 240, e.g., that may be operatively coupled to control panel 148 for user manipulation to select features and operations of ice making assembly 200. Controller 240 can operates various components of ice making assembly 200 to execute selected system cycles and features. For example, controller 240 is in operative communication with ice making motor 224, fan 226 and heater 230. Thus, controller 240 can selectively activate and operate ice making motor 224, fan 226 and heater 230.

Controller 240 may include a memory and microprocessor, such as a general or special purpose microprocessor operable to execute programming instructions or micro-control code associated with operation of ice making assembly 200. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 240 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Ice making motor 224, fan 226 and heater 230 may be in communication with controller 240 via one or more signal lines or shared communication busses.

Ice making assembly 200 also includes a temperature sensor 228 (FIG. 4). Temperature sensor 228 is configured for measuring a temperature of casing 220 and/or liquids, such as liquid water, within casing 220. Temperature sensor 228 can be any suitable device for measuring the temperature of casing 220 and/or liquids therein. For example, temperature sensor 228 may be a thermistor or a thermocouple. Controller 240 can receive a signal, such as a voltage or a current, from temperature sensor 240 that corresponds to the temperature of the temperature of casing 220 and/or liquids therein. In such a manner, the temperature of casing 220 and/or liquids therein can be monitored and/or recorded with controller 240.

Figure 6:
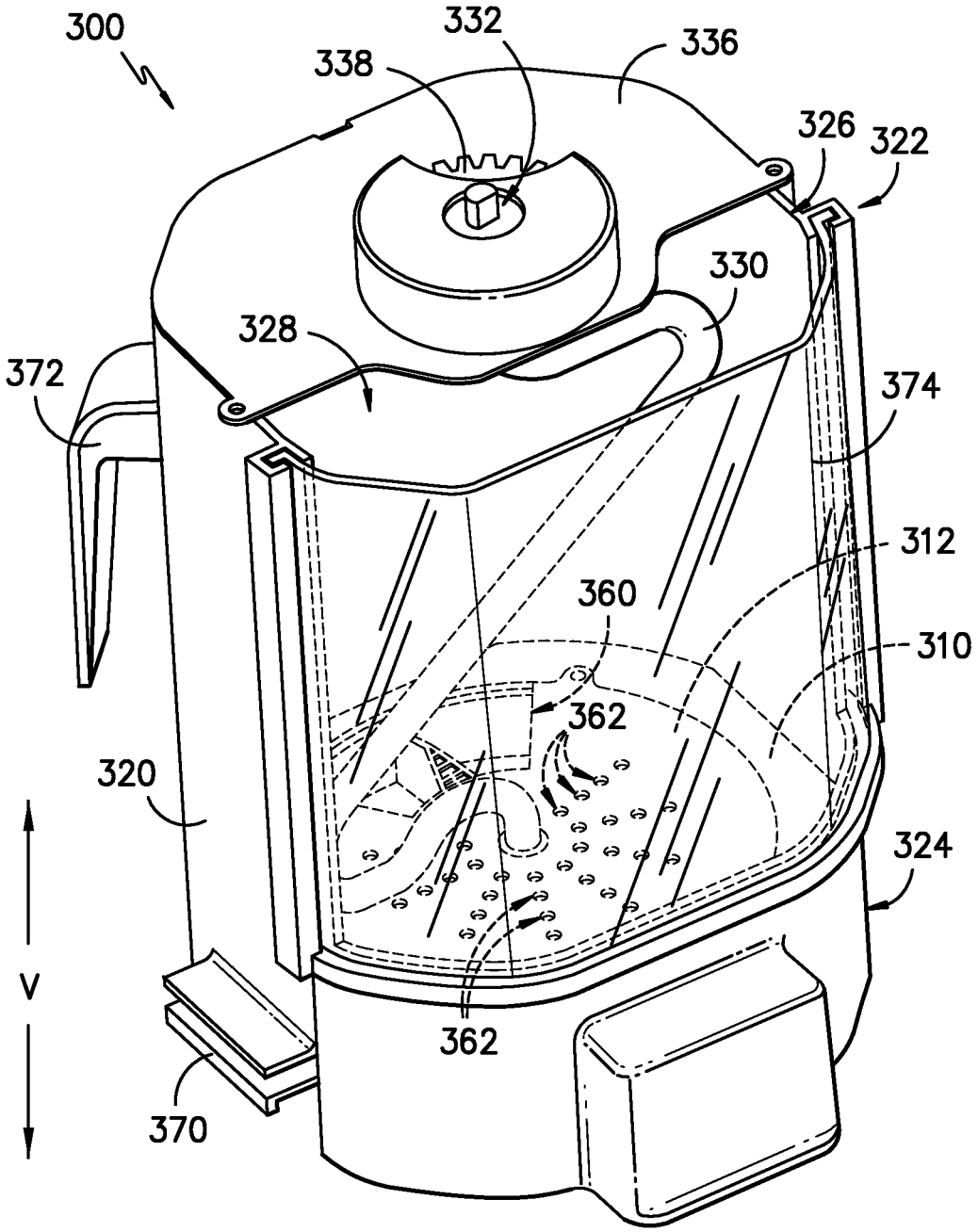
FIG. 6 provides a perspective view of an ice bucket according to an exemplary embodiment of the present subject matter.
Figure 7:
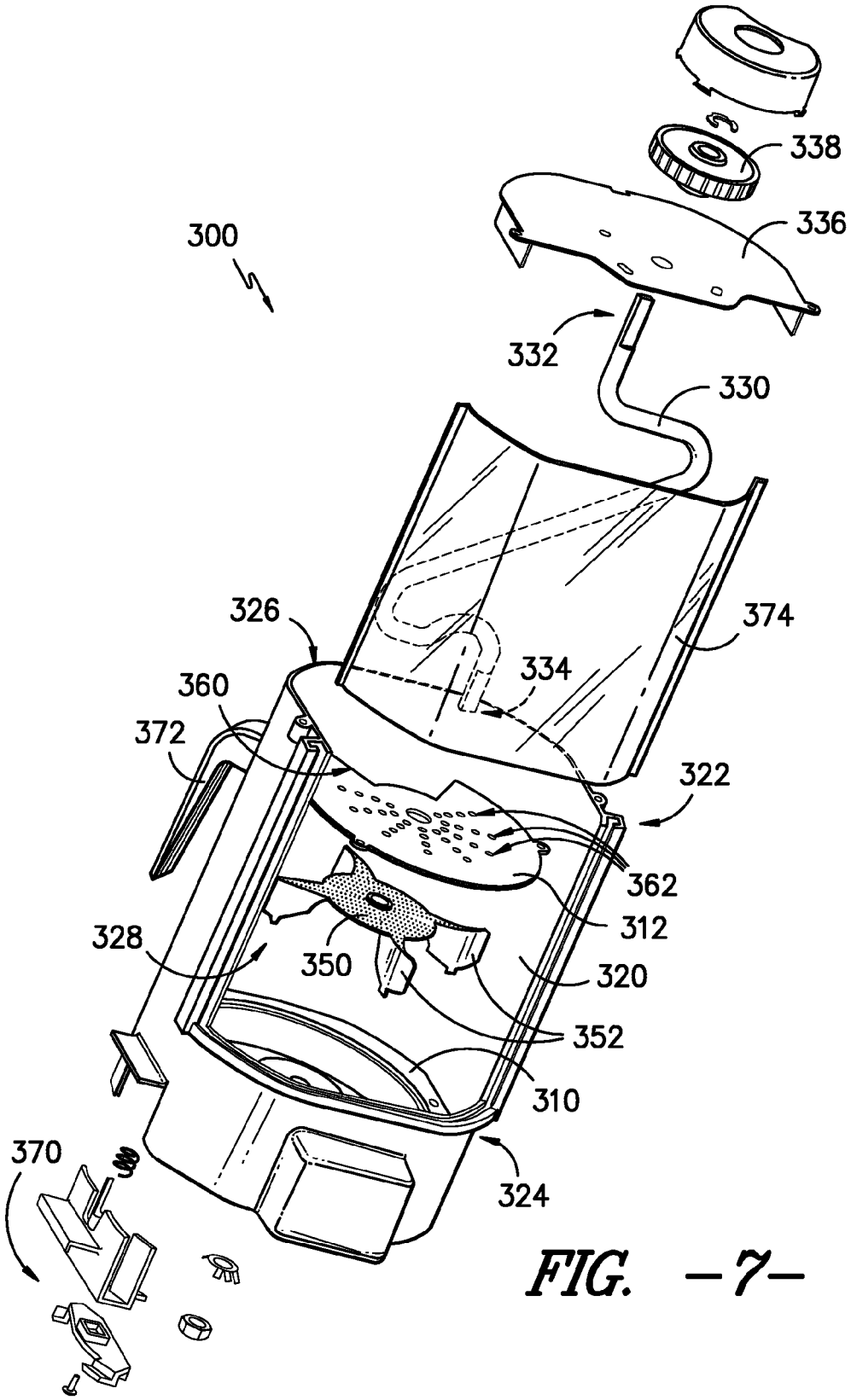
FIG. 7 provides an exploded view of the exemplary ice bucket of FIG. 6.

FIG. 6 provides a perspective view of an ice storage bin or ice bucket 300 according to an exemplary embodiment of the present subject matter. FIG. 7 provides an exploded view of ice bucket 300. Ice bucket 300 can be used in any suitable refrigerator appliance or ice making assembly. For example, ice bucket 300 may be used in refrigerator appliance 100 as ice storage bin 164 (FIG. 3) or ice making assembly 200 as ice bucket 210.

As may be seen in FIG. 6, ice bucket 300 includes a bottom wall 310 and sidewall 320. Sidewall 320 extends between a top portion 322 and a bottom portion 324, e.g., along the vertical direction V. Bottom wall 310 is mounted to sidewall 320 at or adjacent bottom portion 324 of sidewall 320. Thus, bottom wall 310 is positioned at or adjacent bottom portion 324 of sidewall 320.

Sidewall 320 defines an opening 326, e.g., at top portion 322 of sidewall 320. Sidewall 320 also defines a storage volume 328. Storage volume 328 can extend along the vertical direction V between about the top and bottom portions 322 and 324 of sidewall 320 within sidewall 320. Opening 326 is positioned (and configured) for receiving ice nuggets, e.g., from casing 220 and/or extruder 225 via ice nugget conduit 227 such that ice nuggets from ice making assembly 200 enter storage volume 328 at opening 326. Ice bucket 300 also includes a top wall 336. Top wall 336 is mounted to sidewall 320 at or adjacent top portion 322 of sidewall 320. Thus, top wall 336 is positioned at or adjacent top portion 322 of sidewall 320, e.g., and opening 326.

An ice bucket auger 330 is disposed within storage volume 328. An ice bucket motor 231 of ice bucket 210 can be in mechanical communication (e.g., coupled to) ice bucket auger 330. For example, a first gear 338 is fixed or coupled to ice bucket auger 330, e.g., at a proximal end portion 332 of ice bucket auger 330. First gear 338 assists with mechanically coupling ice bucket auger 330 to ice bucket motor 231. In particular, a second gear 239 of ice bucket 210 is fixed or coupled to ice bucket motor 231, e.g., an axle of ice bucket motor 231.

Ice bucket motor 231 of ice bucket 210 can selectively rotate ice bucket auger 330 within storage volume 328. For example, first and second gears 338 and 239 mesh together in order to mechanically couple ice bucket motor 231 and ice bucket auger 330 such that ice bucket motor 231 can selectively rotate second gear 239 in order to rotate ice bucket auger 330 within storage volume 328. Rotation of ice bucket auger 330 within storage volume 328 can assist with dispensing or removing ice nuggets from storage volume 328 as discussed in greater detail below.

A position of storage volume 328 relative to ice bucket motor 231 can assist with protecting or maintaining ice bucket motor 231. In particular, ice bucket motor 231 is positioned above storage volume 328, e.g., along the vertical direction V. As discussed above, storage volume 328 is maintained at a temperature greater than the freezing temperature of liquid water, e.g., to avoid clumping or freezing together of ice nuggets in storage volume 328. Due to the temperature of storage volume 328, ice nuggets therein can melt over time and generate liquid water in storage volume 328. By positioning ice bucket motor 231 above storage volume 328 along the vertical direction V, liquid water in storage volume 328 is unlikely or unable to contact or flow towards ice bucket motor 231. In particular, gravity can urge such liquid water downwardly along the vertical direction V away from ice bucket motor 231.

As may be seen in FIG. 7, ice bucket 300 includes a bottom plate 312. Bottom plate 312 defines an opening 360 and a plurality of holes 362. Ice bucket 300 also includes a sweep 350. Sweep 350 has sweep arms 352. Bottom plate 312 and sweep 350 are discussed in greater detail below.

Ice bucket 300 also includes a handle 372 and a latch assembly 370. Handle 372 is mounted to sidewall 320. A user can grasp handle 372 to lift and move ice bucket 300. Latch assembly 370 is configured for selectively securing ice bucket 300 in an ice receiving position, e.g., below an ice maker, such as ice making assembly 164 within freezer sub-compartment 162 (FIG. 3).

Figure 8:
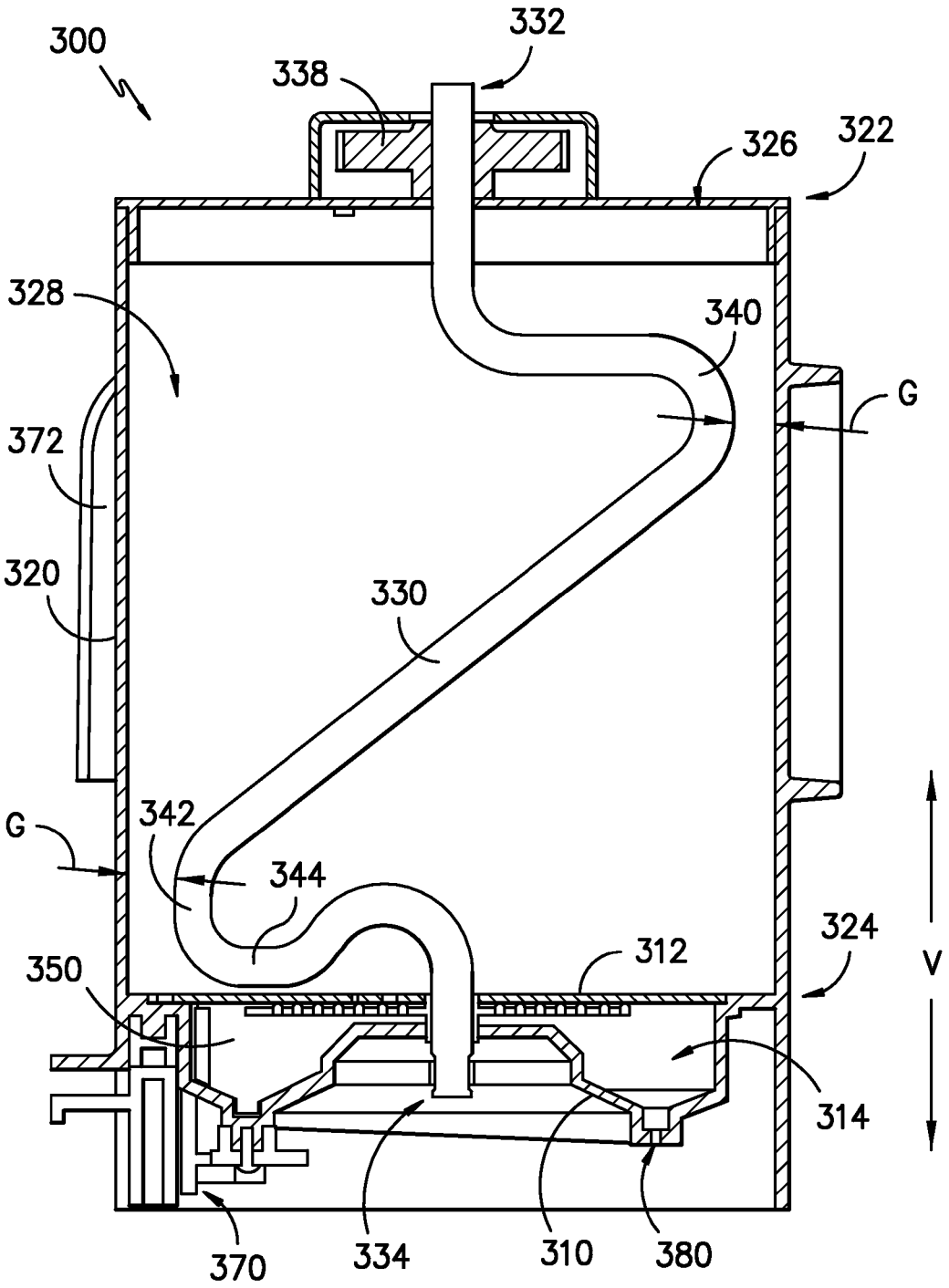
FIG. 8 provides a front, section view of the exemplary ice bucket of FIG. 6.
Figure 9:
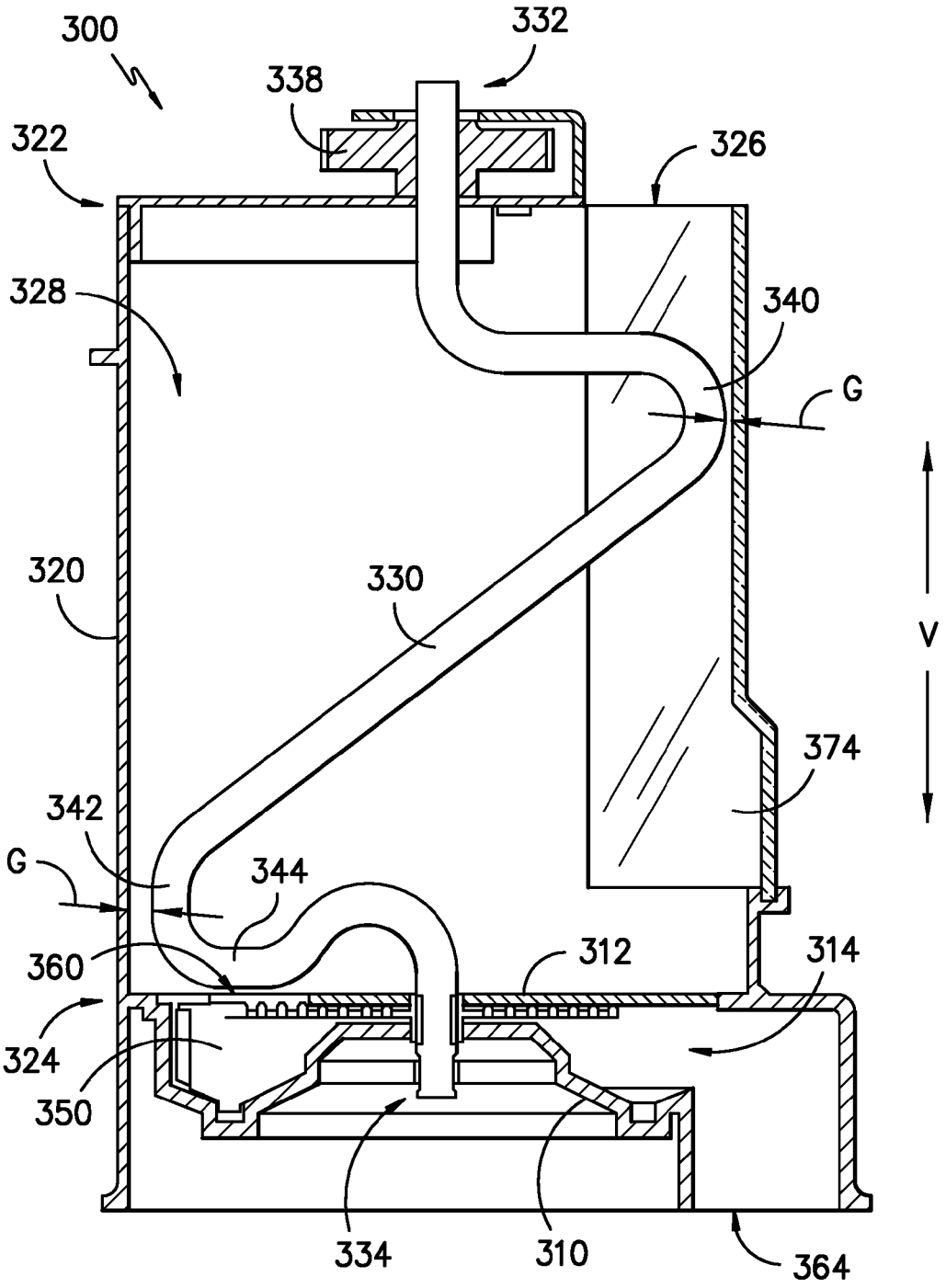
FIG. 9 provides a side, section view of the exemplary ice bucket of FIG. 6.

FIG. 8 provides a front, section view of ice bucket 300. FIG. 9 provides a side, section view of ice bucket 300. FIG. 10 provides a top, section view of ice bucket 300. Features of ice bucket 300 are discussed in greater detail below with reference to FIGS. 8, 9 and 10.

As may be seen in FIG. 8, bottom plate 312 is positioned within sidewall 320, e.g., at bottom portion 324 of sidewall 320. Bottom plate 312 is positioned above bottom wall 310, e.g., along the vertical direction V, such that bottom plate 312 and bottom wall 310 define a dispensing volume 314 therebetween. Dispensing volume 314 is positioned below storage volume 328, e.g., along the vertical direction V. Sweep 350 is disposed or positioned in dispensing volume 314. Sweep 350 is fixed or coupled to ice bucket auger 330, e.g., at a distal end portion 334 of ice bucket auger 330. Thus, sweep 350 rotates within dispensing volume 314 when ice bucket auger 330 rotates within storage volume 328.

Turning now to FIG. 9, bottom plate 312 includes opening 360. Opening 360 of bottom plate 312 is sized for permitting ice nuggets from storage volume 328 to enter dispensing volume 314. Opening 360 of bottom plate 312 is positioned at bottom portion 324 of sidewall 320. Thus, gravity can urge ice nuggets above opening 360 of bottom plate 312 out of storage volume 328 into dispensing volume 314 via opening 360 of bottom plate 312. Rotation of ice bucket auger 330 can assist with moving ice nuggets within storage volume 328 over opening 360 of bottom plate 312 such that ice nuggets move from storage volume 328 into dispensing volume 314.

Bottom wall 310 also defines an ice chute 364. Ice chute 364 is sized for directing ice nuggets out of dispensing volume 314. For example, rotation of sweep 350 within dispensing volume 314 can move ice nuggets within dispensing volume 314 from opening 360 of bottom plate 312 to ice chute 364. Thus, sweep arms 352 of sweep 350 can move ice nuggets from opening 360 of bottom plate 312 to ice chute 364 during rotation of sweep 350. In such a manner, ice nuggets can be dispensed from storage volume 328 and/or dispensing volume 314 without crushing the ice nuggets.

As may be seen in FIGS. 8 and 9, ice bucket auger 330 extends between a proximal end portion 332 and a distal end portion 334. Proximal and distal end portions 332 and 334 of ice bucket auger 330 are spaced apart from each other, e.g., along the vertical direction V. Proximal end portion 332 of ice bucket auger 330 is positioned proximate top portion 322 of sidewall 320. Conversely, distal end portion 334 of ice bucket auger 330 is positioned proximate bottom portion 324 of sidewall 320. In particular, proximal end portion 332 of ice bucket auger 330 is rotatably mounted to top wall 336, and distal end portion 334 of ice bucket auger 330 is rotatably mounted to bottom wall 310.

As also may be seen in FIGS. 8 and 9, ice bucket auger 330 has a serpentine or tortuous pattern, e.g., between proximal end portion 332 and a distal end portion 334 along the vertical direction V. In particular, ice bucket auger 330 includes a first portion 340 and a second portion 342. First and second portions 340 and 342 of ice bucket auger 330 are disposed in storage volume 328, e.g., on opposite sides of storage volume 328, and are positioned between proximal and distal end portions 332 and 334 of ice bucket auger 330. First portion 340 of ice bucket auger 330 is positioned adjacent sidewall 320, e.g., at or adjacent top portion 322 of sidewall 320. Second portion 342 of ice bucket auger 330 positioned adjacent sidewall 320, e.g., at or adjacent bottom portion 324 of sidewall 320.

By having both first and second portions 340 and 342 of ice bucket auger 330 disposed adjacent sidewall 320, ice bucket auger 330 can assist with breaking up clumps of ice nuggets in storage volume 328 during rotation of ice bucket auger 330 in storage volume 328. In particular, ice bucket auger 330 can pass close to sidewall 320 and hinder accumulation or collection of ice nuggets at sidewall 320. In particular, ice bucket auger 330 (e.g., first portion 340 or second portion 342 of ice bucket auger 330) and sidewall 320 define a gap G therebetween. A size of the gap G can vary during rotation of ice bucket auger 330 within storage volume 328. In particular, the size of the gap G can be any suitable size during rotation of ice bucket auger 330 within storage volume 328. For example, the gap G may be less than about half an inch and greater than about one sixteenth of an inch during rotation of ice bucket auger 330 in storage volume 328.

Ice bucket auger 330 also includes a third portion 344. Third portion 344 of ice bucket auger 330 is positioned adjacent, e.g., and parallel to, bottom plate 312. Third portion 344 of ice bucket auger 330 can scrape or move ice nuggets on bottom plate 312 towards opening 360 of bottom plate 312 during rotation of ice bucket auger 330 in storage volume 328. In such a manner, ice bucket auger 330 can pass close to bottom plate 312 and hinder accumulation or collection of ice nuggets on bottom plate 312.

As may be seen in FIG. 8, ice bucket 300 also includes a drain 380, e.g., defined by bottom wall 310. Drain 380 directs liquid water out of dispensing volume 314. As discussed above, ice nuggets in storage volume 328 can melt over time and generate liquid water in storage volume 328. Liquid water in storage volume 328 can flow out of storage volume 328 through holes 362 in bottom plate 312 to dispensing volume 314, and such liquid water can be directed out of ice bucket 300 though drain 380 in dispensing volume 314. In such a manner, liquid water is prevented or hindered from collecting within ice bucket 300.

Turning now to FIG. 10, sidewall 320 has a substantially circular or round cross-section, e.g., in a plane that is perpendicular to the vertical direction V. In such a manner, ice bucket auger 330 can travel through a majority or most of storage volume 328 during rotation of ice bucket auger 330 within storage volume 328. Thus, clumping of ice nuggets, e.g., on sidewall 320, is prevented or limited.

Sidewall 320 can be constructed in any suitable manner. For example, sidewall 320 may be constructed with a single molded material. As another example, sidewall 320 may be constructed of multiple components including a window 374 that permits a user of ice bucket 300 to view storage volume 328.

FIG. 11 provides a perspective view of an auger 400 according to an exemplary embodiment of the present subject matter. Auger 400 may be used in any suitable ice bucket. For example, auger 400 may be used in ice bucket 210 (FIG. 5) or ice bucket 300 (FIG. 6). Auger 400 operates in a similar manner to ice bucket auger 330 and includes similar features.

Auger 400 extends between a first end portion 412 and a second end portion 414. First and second end portions 412 and 414 of auger 400 are spaced apart from each other, e.g., along the vertical direction V. First end portion 412 of auger 400 may be rotatably mounted to top wall 336 of ice bucket 300, and second end portion 414 of auger 400 may be rotatably mounted to bottom wall 310 of ice bucket 300.

As also may be seen in FIG. 11, auger 400 includes a central post 430 with a plurality of projections 420 mounted thereto. Projections 420 are, e.g., uniformity, dispersed or distributed between first and second end portions 412 and 414 of auger 400. Thus, projections 420 are spaced apart from each other, e.g., along the vertical direction. Each projection of projections 420 includes a distal end portion 422 that may be positioned adjacent or proximate sidewall 320 of ice bucket 200. Thus, projections 420 may extend, e.g., radially, from central post 430 towards sidewall 320.

Projections 420 can assist with breaking up clumps of ice nuggets in storage volume 328 during rotation of auger 400 in storage volume 328. In particular, distal end portions 422 of projections 420 can pass close to sidewall 320 and hinder accumulation or collection of ice nuggets at sidewall 320. In particular, distal end portions 422 of projections 420 and sidewall 320 can define gap G therebetween. As discussed above, a size of the gap G can vary during rotation of auger 400 within storage volume 328. For example, the gap G may be less than about half an inch and greater than about one sixteenth of an inch during rotation of auger 400 in storage volume 328.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly that defines a vertical direction, comprising:

a casing;

an ice making auger rotatably mounted within the casing;

an ice making motor configured for selectively rotating the ice making auger within the casing;

a removable ice bucket comprising a bottom wall;

a sidewall extending between a top portion and a bottom portion along the vertical direction, the sidewall defining an opening at the top portion of the sidewall, the sidewall mounted to the bottom wall at the bottom portion of the sidewall, the sidewall defining a handle and a storage volume, the opening positioned for receiving ice nuggets from the casing such that ice nuggets from the casing enter the storage volume at the opening;

an ice bucket auger disposed within the storage volume;

an ice bucket motor configured for selectively rotating the ice bucket auger within the storage volume, the ice bucket motor positioned above the storage volume along the vertical direction;

a latch assembly configured for selectively securing the ice bucket in an ice receiving position; and a first gear fixed to the ice bucket auger at the proximal end portion of the ice bucket auger, the first gear permitting removable coupling of the ice bucket auger to a second gear on the ice bucket motor.

2. The ice making assembly of claim 1, wherein the ice bucket auger extends between a distal end portion and a proximal end portion, the proximal end portion of the ice bucket auger positioned proximate the top portion of the sidewall, the distal end portion of the ice bucket auger positioned proximate the bottom portion of the sidewall.

3. The ice making assembly of claim 2, wherein the distal end portion of the ice bucket auger is rotatably mounted to the bottom wall.

4. The ice making assembly of claim 2, further comprising a top wall mounted to the sidewall at the top portion of the sidewall, the proximal end portion of the ice bucket auger rotatably mounted to the top wall.

5. The ice making assembly of claim 2, wherein the ice bucket auger comprises a first portion and a second portion, the first and second portions of the ice bucket auger disposed in the storage volume between the distal and proximal end portions of the ice bucket auger, the first portion of the ice bucket auger positioned adjacent the sidewall at the top portion of the sidewall, the second portion of the ice bucket auger positioned adjacent the sidewall at the bottom portion of the sidewall.

6. The ice making assembly of claim 1, further comprising a bottom plate positioned within the sidewall, the bottom plate positioned above the bottom wall along the vertical direction such that the bottom plate and the bottom wall define a dispensing volume therebetween, the dispensing volume positioned below the storage volume along the vertical direction.

7. The ice making assembly of claim 6, further comprising a sweep disposed in the dispensing volume, the sweep coupled to the ice bucket auger such that the sweep rotates with the ice bucket auger.

8. The ice making assembly of claim 6, wherein the bottom plate defines an opening, the opening of the bottom plate sized for permitting ice nuggets from the storage volume to enter the dispensing volume, the bottom wall defining an ice chute sized for directing ice nuggets out of the dispensing volume, the sweep configured for moving ice nuggets from the opening of the bottom plate to the ice chute of the bottom wall during rotation of the sweep.

9. The ice making assembly of claim 1, wherein the sidewall has a substantially circular cross-section in a plane that is perpendicular to the vertical direction.

10. A refrigerator, comprising;

a housing defining a top portion and a bottom portion;

a fresh food chamber positioned adjacent the top portion of the housing;

a freezer chamber positioned adjacent the bottom portion of the housing;

at least one refrigerator door rotatably hinged to an edge of the housing for selectively accessing the fresh food chamber;

at least one freezer door positioned for selectively accessing the freezer chamber;

a dispensing assembly disposed in the at least one refrigerator door configured for selectively dispensing water and ice;

a freezer sub-compartment defined adjacent the dispensing assembly, the freezer sub-compartment extending into the fresh food chamber and communicating air with both the freezer chamber and the fresh food chamber;

an ice making assembly disposed within the freezer sub-compartment, the ice making assembly comprising;

a casing in communication with chilled air from the freezer compartment;

an ice making auger rotatably mounted within the casing;

an ice making motor configured for selectively rotating the ice making auger within the casing;

a removable ice bucket in communication with fresh food air from the fresh food compartment, comprising;

a bottom wall;

a sidewall extending between a top portion and a bottom portion along the vertical direction, the sidewall defining an opening at the top portion of the sidewall, the sidewall mounted to the bottom wall at the bottom portion of the sidewalk the sidewall defining a storage volume, the opening positioned for receiving ice nuggets from the casing such that ice nuggets from the casing enter the storage volume at the opening;

an ice bucket auger disposed within the storage volume;

an ice bucket motor configured for selectively rotating the ice bucket auger within the storage volume, the ice bucket motor positioned above the storage volume along the vertical direction; and a latch assembly configured for selectively securing the ice bucket in an ice receiving position.

11. The refrigerator of claim 10, wherein the ice bucket auger extends between a distal end portion and a proximal end portion, the proximal end portion of the ice bucket auger positioned proximate the top portion of the sidewall, the distal end portion of the ice bucket auger positioned proximate the bottom portion of the sidewall.

12. The refrigerator of claim 11, wherein the distal end portion of the ice bucket auger is rotatably mounted to the bottom wall.

13. The refrigerator of claim 11, further comprising a top wall mounted to the sidewall at the top portion of the sidewalk the proximal end portion of the ice bucket auger rotatably mounted to the top wall.

14. The refrigerator of claim 11, further comprising a first gear fixed to the ice bucket auger at the proximal end portion of the ice bucket auger, the first gear assisting with removably coupling the ice bucket auger to a second gear on the ice bucket motor.

15. The refrigerator of claim 11, wherein the ice bucket auger comprises a first portion and a second portion, the first and second portions of the ice bucket auger disposed in the storage volume between the distal and proximal end portions of the ice bucket auger, the first portion of the ice bucket auger positioned adjacent the sidewall at the top portion of the sidewall, the second portion of the ice bucket auger positioned adjacent the sidewall at the bottom portion of the sidewall.

16. The refrigerator of claim 10, further comprising a bottom plate positioned within the sidewall, the bottom plate positioned above the bottom wall along the vertical direction such that the bottom plate and the bottom wall define a dispensing volume therebetween, the dispensing volume positioned below the storage volume along the vertical direction.

17. The refrigerator of claim 16, further comprising a sweep disposed in the dispensing volume, the sweep coupled to the ice bucket auger such that the sweep rotates with the ice bucket auger.

18. The refrigerator of claim 16, wherein the bottom plate defines an opening, the opening of the bottom plate sized for permitting ice nuggets from the storage volume to enter the dispensing volume, the bottom wall defining an ice chute sized for directing ice nuggets out of the dispensing volume, the sweep configured for moving ice nuggets from the opening of the bottom plate to the ice chute of the bottom wall during rotation of the sweep.

19. The refrigerator of claim 10, wherein the freezer sub-compartment comprises slots in an access door configured to communicate air from the fresh food chamber such that ice nuggets in the ice bucket melt over time to prevent clumping.

* * * * *